United States Patent [19]

Bustos

[11] 4,411,367

[45] Oct. 25, 1983

[54] MOBILE DISPLAY RACK

[75] Inventor: Rafael T. Bustos, Atlanta, Ga.

[73] Assignee: Leggett & Platt, Incorporated, Carthage, Mo.

[21] Appl. No.: 287,437

[22] Filed: Jul. 27, 1981

[51] Int. Cl.[3] ..... A47F 7/28

[52] U.S. Cl. ..... 211/187; 211/74; 211/49 S; 414/92; 414/97; 414/608; 414/786

[58] Field of Search ..... 211/187, 186, 207, 49 S, 211/74; 108/106; 414/608, 69, 786, 92, 97

[56] References Cited

U.S. PATENT DOCUMENTS

| | | | |
|---|---|---|---|
| 1,730,439 | 10/1929 | Stepanian | 211/74 |
| 2,677,470 | 5/1954 | Catalano | 211/186 X |
| 2,702,127 | 2/1955 | Pastorius et al. | 211/186 X |
| 2,830,825 | 4/1958 | Webber et al. . | |
| 2,935,205 | 5/1960 | Higgin . | |
| 3,056,507 | 10/1962 | Squires et al. | 108/106 |
| 3,161,158 | 12/1964 | Lurey . | |
| 3,207,322 | 9/1965 | Pederson | 211/190 |
| 3,522,954 | 8/1970 | Locke . | |
| 4,119,045 | 10/1978 | Michelotti | 211/186 X |
| 4,159,831 | 7/1979 | Schorr | 211/49 D X |

*Primary Examiner*—Ramon S. Britts
*Assistant Examiner*—Robert W. Gibson, Jr.
*Attorney, Agent, or Firm*—Wood, Herron & Evans

[57] ABSTRACT

A mobile display rack for the storage and display of packaged products. The display rack includes a frame structure comprising four vertically disposed support members supporting at or near their tops a vertically stationary top shelf. Within the frame structure positioned one above the other but below the stationary top shelf are a plurality of vertically movable shelves adapted to hold product containers. Each movable shelf has a lowest vertical position determined by a shelf stop assembly affixed to the frame structure, and a highest vertical position determined by the movable shelves above it. When the movable shelves are loaded with containers and the lowest shelf raised by an appropriate means such as a fork lift, the shelf will move upwardly until the tops of the containers contact the bottom of the shelf immediately above it which shelf, in turn, will move upwardly until the tops of the containers on it contact the bottom of the shelf immediately above it, and so on, until the tops of the containers on the uppermost movable shelf contact the bottom of the top stationary shelf, at which point all of the containers are under a compressive force rendering them immovable, thereby providing a stable, loaded, display rack that can safely be moved from one point to another.

5 Claims, 8 Drawing Figures

MOBILE DISPLAY RACK

BACKGROUND OF THE INVENTION

1. Field of the Invention

The present invention relates to product display racks. More particularly, the present invention relates to a display rack for displaying product on a plurality of shelves, and which can be quickly and easily converted from its display condition to a stable, mobile condition, whereby the loaded display rack can be safely moved from point to point.

2. Description of the Prior Art

The prior art abounds with display racks, as contrasted to conventional shelving, for displaying products, such as bottled and canned products, in special areas of marketing facilities such as super markets, and the like. Many of these are stationary racks to which the product intended to be displayed is brought from a storage area either by hand or by some form of mobile cart. In either event, an intermediate handling of the product between its storage point and its display point is necessary. To eliminate this intermediate handling of product, smaller racks have simply been made mobile by the addition of wheels so that a loaded rack can be moved between storage area and display area. Because the load capacity of such racks is relatively small, product can be safely moved with little, if any, further modification to the rack. The same, however, cannot be said for normally stationary, large display racks which, because of their size and load capacity cannot be made safely mobile simply by the addition of wheels.

Accordingly, there are in the prior art display racks or carts that have been specifically designed for mobility and for transporting and displaying large product loads. Such mobile racks, however, usually have been difficult to maneuver in confining areas, and generally have not provided for adequately securing the product load against shifting and resulting breakage during movement. One mobile display rack that has taken these factors into consideration, however, is shown and described in U.S. Pat. No. 4,159,831. The mobile rack of this patent comprises a wheeled frame structure having a plurality of horizontal shelves vertically adjustable and pivotably attached to two vertical tracks on the back wall of the frame structure. As each shelf is loaded with containers, the next higher shelf is pivoted into contact with the container tops, and the procedure repeated with each succeeding higher shelf until all shelves are loaded. The frame structure also comprises a similarly pivoted top cap which can be brought into contact with the tops of the containers on the top shelf, and which can be maintained in a state of compression with the entire stacked load by means of an adjustable tie down strap connecting the cap with the bottom shelf, whereby all of the containers can be firmly secured against shifting during movement of the rack. While the described mobile rack should function satisfactorily in storing and safely moving a large load of product to a display area, its pivoting shelves used in conjunction with the tie down strap for securing the load against movement by compression is a rather awkward arrangement which can be ineffective if not used properly.

SUMMARY OF THE INVENTION

It is an object of this invention, therefore, to provide a mobile display rack designed for displaying large numbers of vertically stacked product containers. It is a further object of this invention to provide such a mobile display rack capable of transporting a large load of vertically stacked product containers from a reserve storage area to a display area thereby eliminating handling of the product containers intermediate the two areas. It is still a further object of this invention to provide means associated with such a mobile display rack for firmly securing a large load of vertically stacked containers in the rack thereby permitting movement of the rack without risk of load shifting and possible resultant breakage or damage. It is an additional object of this invention to provide such a mobile display rack which may be safely and easily maneuvered in confining spaces using equipment and personnel normally present in any large market.

A mobile display rack for use in super markets, and the like, according to the objects of this invention includes a frame structure of rectangular configuration comprising four vertically disposed support members supporting at or near their tops a stationary top shelf. Within the frame structure position one above the other but below the top shelf are a plurality of vertically movable shelves each adapted to hold a plurality of product containers. Each shelf has a lowest vertical position in the frame structure determined by a shelf stop assembly affixed to the frame structure, and a highest vertical position in the frame structure determined by the shelves above it. In operation, each movable shelf receives containers the height of which governs the setting of the shelf stop assembly. When the lowest movable shelf is raised by any appropriate means, as by fork lift, it will move upwardly until the tops of its containers contact the bottom of the shelf immediately above it, which shelf, in turn, will move upwardly together with the first shelf until the tops of the containers on the second shelf contact the bottom of the shelf immediately above it, and so on, until the tops of the containers on the highest movable shelf contact the bottom of the stationary top shelf, at which point all of the containers on the movable shelves are compressed into immovable positions. Thus, the load of the rack is given great stability in a very simple and effective manner so that the loaded rack can be moved with little, if any, risk of load shifting. Once the state of compression is reached, the loaded rack can be safely moved from one point to another, such as from a reserve storage area to a display area. At this latter point, the means used to raise the shelves can then be used to reverse the action so that all of the shelves with their containers are returned to their lowest vertical levels as determined by the shelf stop assemblies affixed to the frame structure, leaving the rack in its display condition. On removing an empty or partially empty display rack from the display area, the same procedure is followed.

DESCRIPTION OF THE PREFERRED EMBODIMENT

Figure 1:
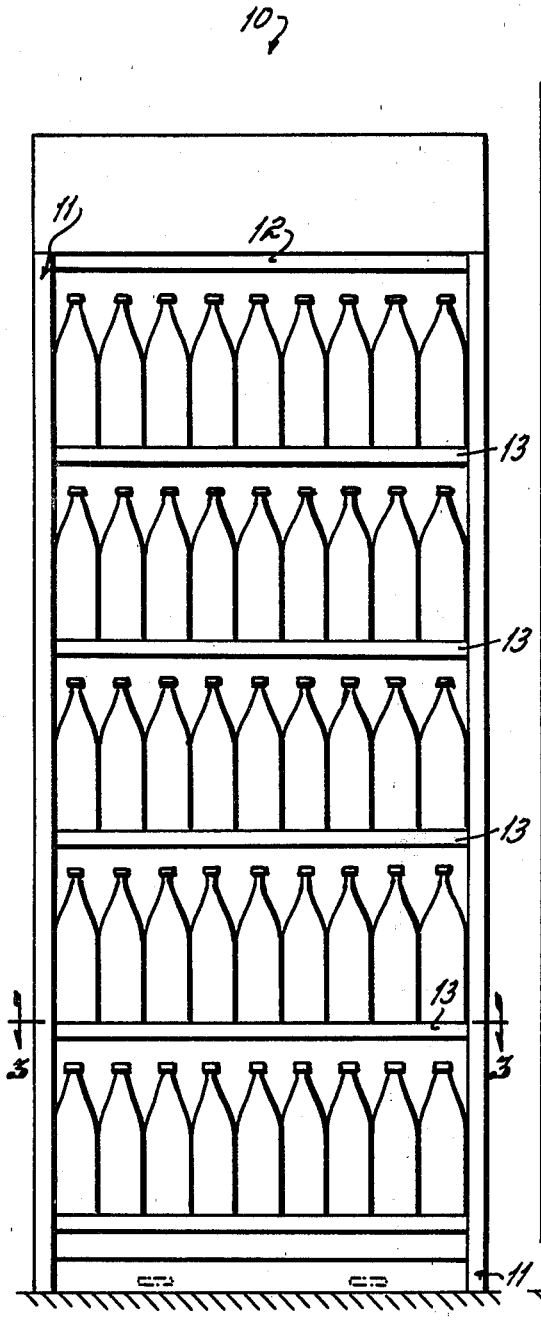
FIG. 1 is a front view of a mobile display rack in its loaded, decompressed, display condition.
Figure 2:
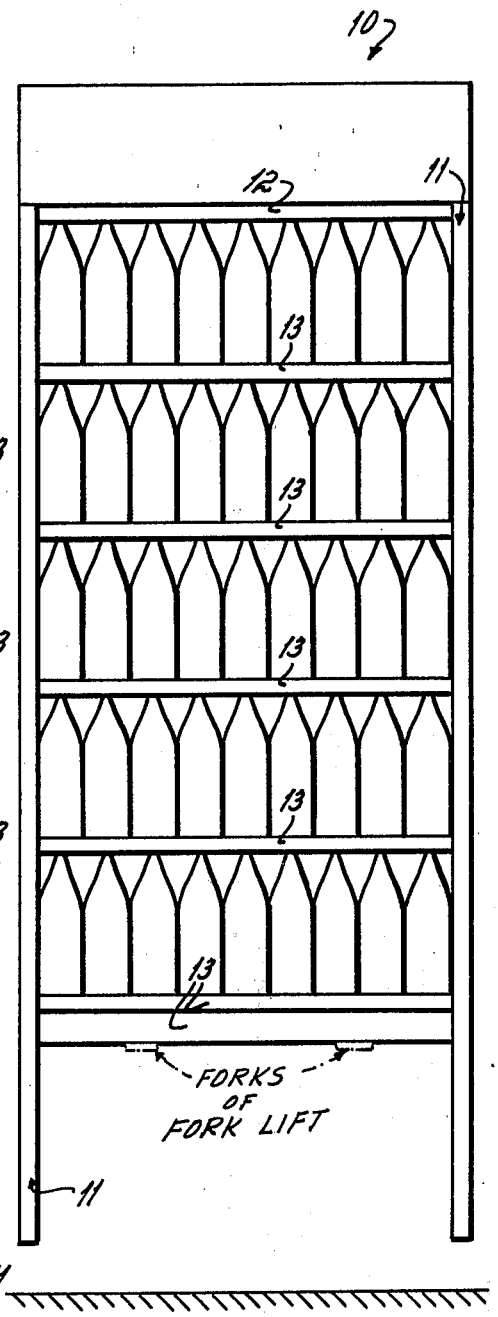
FIG. 2 is a front view of a mobile display rack in its loaded, compressed, transport condition.
Figure 3:
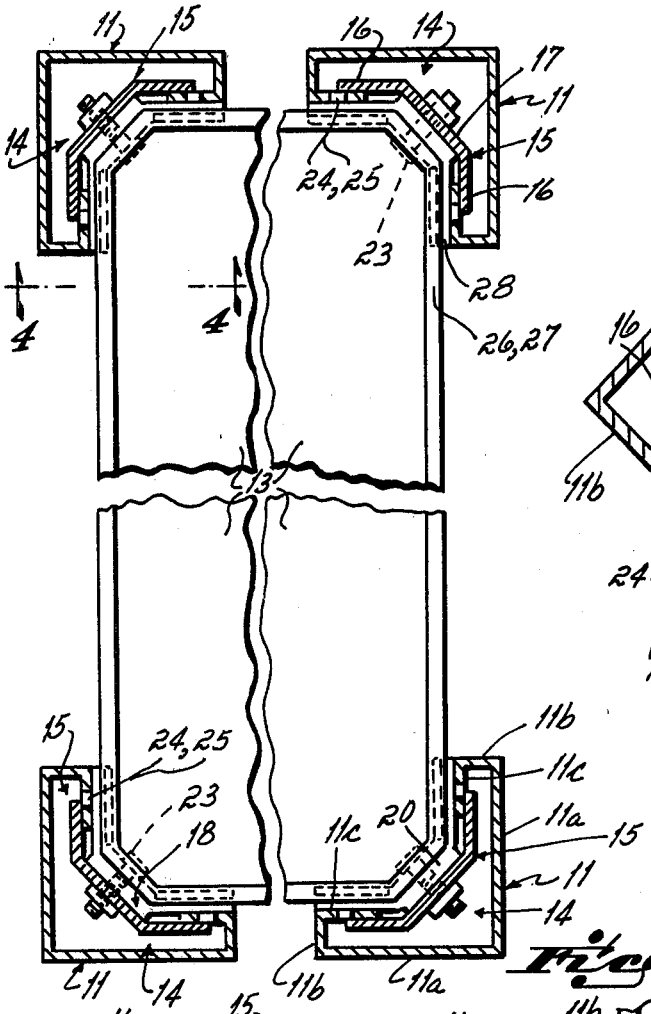
FIG. 3 is a top view, partially broken away, taken on the line 3—3 of FIG. 1 showing one form of shelf stop assembly.
Figure 3A:
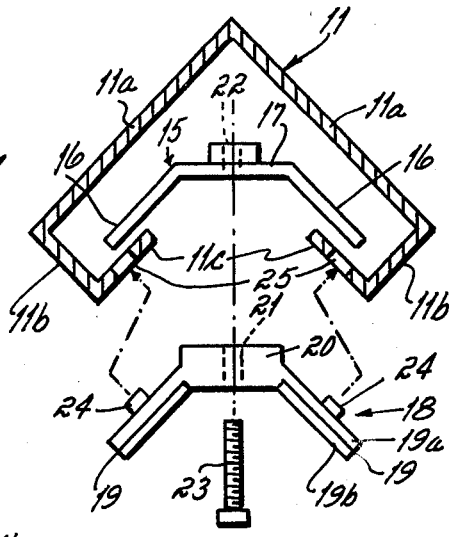
FIG. 3A is a disassembled view of the shelf stop assembly of FIG. 3.

Referring to the drawing, FIGS. 1 and 2 show the mobile display rack of this invention generally indicated at 10 comprising four frame support members 11 supporting at or near the top thereof a stationary shelf 12, which together form a display rack frame structure of rectangular configuration. Each frame support member 11 is right-angle shaped having two arms 11*a*, the end of each of which is formed into a return U-shaped 11*b* having an inside arm 11*c* shorter than the parallel outside arm 11*a*, all as illustrated in FIGS. 3 and 3A. Frame support members 11 are joined by cross support members, not shown, which give the frame structure rigidity, such cross support members being judiciously located so as not to interfere with the use of the display rack as subsequently described herein. Located within the frame structure below stationary shelf 12 are a plurality of vertically movable shelves 13 one above the other, the number of which may vary but which are shown in FIG. 1 as five.

Shelves 13 are vertically free moving having a lowest vertical position determined by shelf stop assemblies 14, each of which comprises four units or sets, one such unit or set affixed to each support member 11. As shown in FIGS. 3 and 3A, each unit or set comprises a generally U-shaped clamp 15, the arms 16 of which are disposed at angles to the base 17 so that when the unit is assembled, each arm 16 fits flush against the inside face of corresponding arm 11*c* of U-shaped member 11*b*. Cooperating with U-shaped clamp 15 is a correspondingly U-shaped shelf stop member 18 the arms 19 of which are each provided with a lower section 19*a* on which is a projection 24 adapted to fit snugly into aperture 25 of arm 11*c* when assembled. Offset from lower section 19*a* is an upper section 19*b* which cooperates with arm 11*c* to form channel 28. Base 20 of shelf stop member 18 is provided with an aperture 21 that is aligned with a threaded aperture 22 in base 17 of clamp 15, the two apertures being adapted to receive set screw 23 when assembled.

Figure 4:
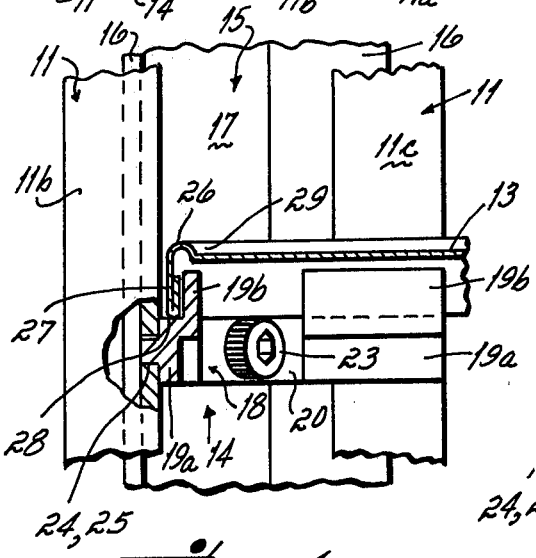
FIG. 4 is a side view, partially broken away, taken on the line 4—4 of FIG. 3 showing the shelf stop assembly of FIG. 3 with a movable shelf in its lowest position.
Figure 5:
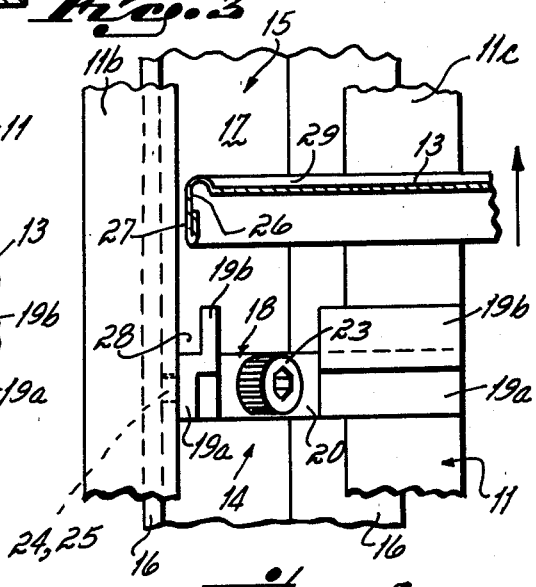
FIG. 5 is a side view similar to FIG. 4 showing the movable shelf in a raised position.

As shown in FIGS. 3, 4 and 5, each vertically movable shelf 13 is fashioned at each of its four corners in the same generally U-shaped manner as are clamp 15 and shelf stop member 18. Each corner of shelf 13 is provided with a lip 26, which may extend around the entire periphery of shelf 13, the descending arm 27 of which lodges and is supported in channel 28 when shelf 13 is in its lowest vertical position as illustrated in FIG. 4. The extension of lip 26 about shelf 13 may be provided with a rim 29 which serves to retain containers on the shelf, particularly when the rack is in its display condition as in FIG. 1. Each shelf 13 is further provided on its upper surface with recesses, not shown, for properly locating containers placed thereon, while the bottom or underside of each shelf 13, and stationary shelf 12, is provided with cavities, also not shown, in which the tops of the containers located on the shelf immediately below are lodged and prevented from moving when shelves 13 are raised out of their channels 28 and placed under compression, as illustrated in FIG. 5.

In use of the mobile display rack of this invention for displaying package goods in large volumes, such as bottled soft drinks as illustrated in FIGS. 1 and 2, the lowest vertical position of each movable shelf 13 is first preset for the particular bottle size to be displayed. Since display rack 10 can only display one bottle size at any one time, presetting of the movable shelves is initially necessary, and, of course, when bottle sizes are changed during use, resetting is required. As a full complement of bottles is placed on each shelf 13, the bottom of each bottle is placed in a locater recess provided for it. These recesses can be designed directly into each shelf 13 or, more preferably, separate locator forms can be used, the locater forms being interchanged as the bottle size of a display rack is varied. On completion of loading of shelves 13, the display rack will be in its decompressed, or display, condition as illustrated in FIG. 1.

To prepare the display for transport, it is only necessary to place the forks of a fork lift beneath the bottom movable shelf 13, as indicated in FIG. 1, and a lifting action initiated. The upward movement of the forks begins to lift the bottom shelf 13 out of its lodgement in channel 28 of shelf stop assembly 14. As shelf 13 with its load of bottles continues to rise, the caps of the bottles approach the bottom of the next higher shelf 13 and enter cavities provided in its undersurface. As contact is made and upward movement of the forks continued, the second shelf 13 begins to move upwardly out of its lowest position in channel 28 until its load of bottles contacts the underside of the third movable shelf 13. Continued upward movement of shelves 13 proceeds until the bottles on the uppermost shelf 13 contact the bottom of stationary shelf 12. The upward pressure of the forks of the fork lift transmitted through successive shelves 13 against the stationary shelf 12 places the entire display load under a compressive force sufficient to impart to the load the necessary stability to permit the display rack to be moved by fork lift from one location to another while in its compressed, or transport, condition as illustrated in FIG. 2. On arriving at the new location, the loaded rack is decompressed by lowering the forks until shelves 13 contact their respective shelf stop assemblies 14, at which point the display rack is again in its decompressed, or display, condition as illustrated in FIG. 1.

Figure 6:
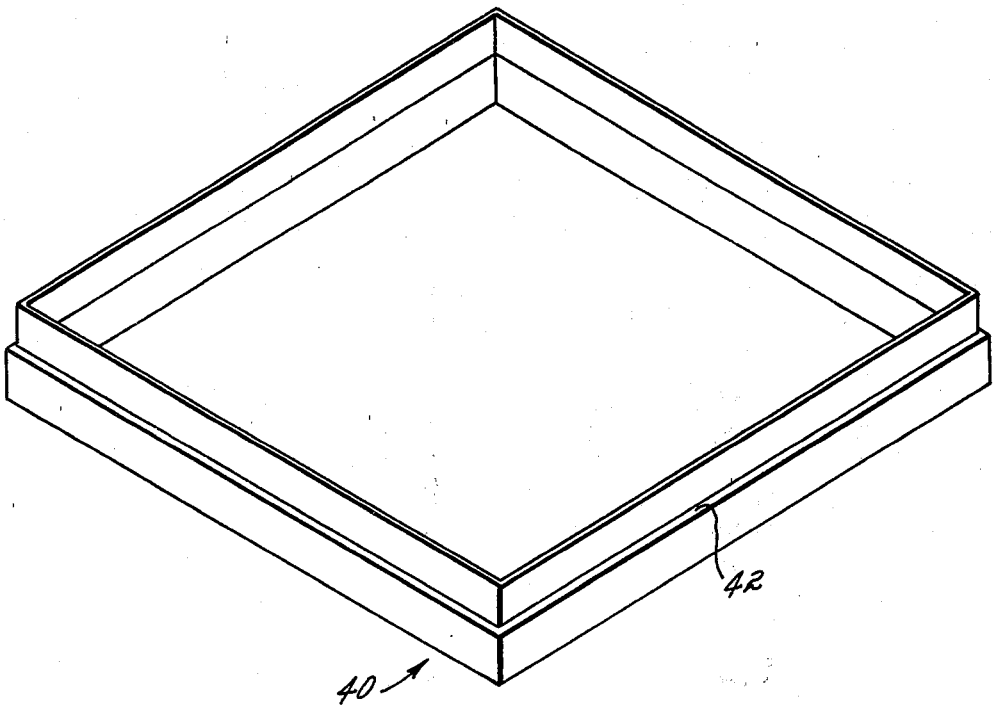
FIG. 6 is a perspective view of another form of shelf stop assembly.
Figure 7:
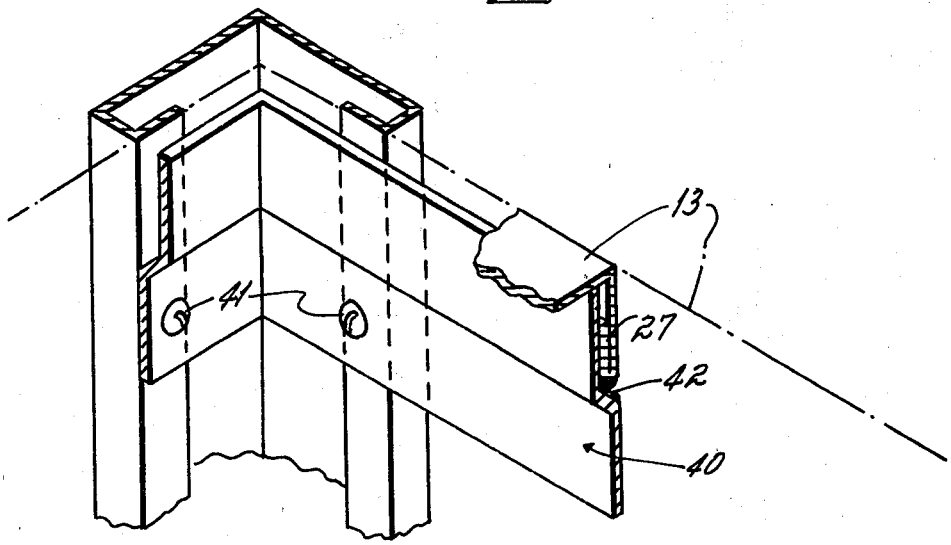
FIG. 7 is a partial perspective view of the shelf stop assembly of FIG. 6 affixed to the frame structure.

A modification by which the display rack of this invention is provided with its own means of mobility is illustrated in FIGS. 6 and 7. In this modification, the shelf stop assembly 14 provided for each movable shelf 13 in the first modification is replaced by a shelf stop assembly comprising a rectangular frame 40 secured at its four corners to the four frame support members 11 by suitable means such as bolts 41 passing through the lower section of frame 40. The upper section of frame 40 is offset inwardly from the lower section to provide a ledge 42 which cooperates with the descending arm 27 of lip 26 provided at the edge of each movable shelf 13 to securely lodge each shelf 13 within its frame 40. The display rack is further provided with support means, not shown, such as a stationary lower shelf, situated below the lowest movable shelf 13, for supporting any suitable lifting means such as a jack.

Once the shelves 13 have been fully loaded with bottles as described with respect to the first modification, the lowest movable shelf 13 is caused to move upwardly by actuating the lifting means located on the lower stationary shelf, thereby separating descending arm 27 from ledge 42 of frame 40. The lifting action is continued with respect to each shelf as previously described until contact is made by the bottles on the uppermost movable shelf 13 with the underside of top stationary shelf 12, whereby a stabilizing, compressive action on the display load is again effected. The loaded display rack, in its compressed, or transport, condition as illustrated in FIG. 2 can now be moved from one location to another without the use of another vehicle by means of wheels, not shown, specifically installed in this modification at each corner of the frame support structure. Upon reaching the new location, the load can be decompressed as before by reversing the action of the lifting means so that shelves 13 are lowered into contact with their respective frames 40, again placing the display rack in its decompressed, or display, condition as in FIG. 1.

From the above description of the mobile display rack of this invention, it can readily be seen that a simple structure has been provided through the use of which even very large numbers of containers can not only be effectively displayed for marketing purposes, but also transported safely and quickly from one point to another. The display rack eliminates the intermediate handling of individual containers between storage and display points, a necessary practice with non-mobile display racks, and also eliminates the awkward and cumbersome straps and other means that have heretofore been used in attempts to provide stability and safety to large mobile display racks. The display rack according to the present invention can be kept in a reserve storage area where the product to be displayed is normally stored in any event. Since the product can be stored in the storage area on the display rack, no additional storage problem is created by use of the rack. When needed, such a fully loaded, stored display rack in its decompressed, or display condition, as in FIG. 1, can quickly and simply be placed in its compressed, transport condition as in FIG. 2, and wheeled directly to its intended display point, from which point an empty or partially empty display rack can be returned to the storage area. In transporting the latter, care must be taken to insure that a container is placed in a recess at each corner of each movable shelf 13 in order to provide for an equal distribution of the compressing force and thereby providing a stable, safely transportable display rack.

I claim:

1. A mobile display rack for transporting and displaying packaged products which comprises: a frame structure of rectangular configuration comprising four vertically disposed support members; a stationary shelf fixedly supported by the support members at or near their tops; a plurality of slidably adjustable, non-fixedly supported shelves positioned one above the other but below the stationary shelf; means including said four vertically disposed support members for supporting said slidably adjustable shelves for slidable vertical adjustment relative to said four vertically disposed support members; and a shelf stop assembly on which each slidably adjustable shelf rests in its lowest vertically adjusted position; said adjustable shelves being adapted to display product containers and when so used to freely move upwardly when a continuing lifting force is applied to the lowest movable shelf whereby the product containers on the lowest movable shelf will contact the bottom of the next highest movable shelf causing that movable shelf to move upwardly so that its containers contact the bottom of the next highest shelf, and so on, until the containers on the uppermost slidable shelf contact the bottom of the stationary shelf thereby compressing all of the containers immovably between the stationary shelf and the lowest slidable shelf.

2. A mobile display rack according to claim 1 in which the shelf stop assembly for each movable shelf comprises four sets each including a generally U-shaped clamp and a correspondingly shaped shelf stop, one set located on each support member of the frame structure, in which the movable shelf is adapted to be securely lodged.

3. A mobile display rack according to claim 1 in which means are provided below the lowest movable shelf for supporting additional means for lifting the movable shelves.

4. A mobile display rack according to claim 3 in which the shelf stop assembly for each movable shelf comprises a rectangular frame secured at each support member in which frame the movable shelf is adapted to be securely lodged.

5. A process for rendering immovable the containers displayed on a plurality of vertically movable shelves positioned one above the other beneath a stationary shelf thereby rendering the displayed containers transportable, which comprises: applying a lifting force to the bottom of the lowest movable shelf thereby raising it so that the containers displayed thereon contact the bottom of the shelf immediately above it, said latter shelf thereby being raised so that the containers displayed on it contact the bottom of the shelf immediately above it, said latter shelf thereby being raised, and so on, until the containers displayed on the uppermost movable shelf contact the bottom of the stationary shelf, whereby all of the containers are placed under a compressive force rendering them immovable on their respective shelves.

* * * * *

UNITED STATES PATENT AND TRADEMARK OFFICE

CERTIFICATE OF CORRECTION

PATENT NO. : 4,411,367

DATED : October 25, 1983

INVENTOR(S) : Rafael T. Bustos

It is certified that error appears in the above-identified patent and that said Letters Patent is hereby corrected as shown below:

Column 3, line 20, after "U-shaped" should be -- member --

Signed and Sealed this

*Twenty-fifth* Day of *September 1984*

[SEAL]

*Attest:*

GERALD J. MOSSINGHOFF

*Attesting Officer*

*Commissioner of Patents and Trademarks*